US008991226B2

(12) United States Patent
Daniels

(10) Patent No.: US 8,991,226 B2
(45) Date of Patent: Mar. 31, 2015

(54) STORM GRATE LOCK DEVICE AND METHOD OF USE

(71) Applicant: Ron R. Daniels, Missouri City, TX (US)

(72) Inventor: Ron R. Daniels, Missouri City, TX (US)

( * ) Notice: Subject to any disclaimer, the term of this patent is extended or adjusted under 35 U.S.C. 154(b) by 0 days.

(21) Appl. No.: 13/745,193

(22) Filed: Jan. 18, 2013

(65) Prior Publication Data

US 2013/0269399 A1 Oct. 17, 2013

Related U.S. Application Data

(60) Provisional application No. 61/588,259, filed on Jan. 19, 2012.

(51) Int. Cl.

| | |
|---|---|
| ***B65D 55/14*** | (2006.01) |
| ***E05B 65/00*** | (2006.01) |
| ***E02D 29/14*** | (2006.01) |
| ***E05B 35/00*** | (2006.01) |
| ***E05C 3/04*** | (2006.01) |

(52) U.S. Cl.

CPC ..... *E05B 65/00* (2013.01); *E02D 29/1427* (2013.01); *E05B 35/008* (2013.01); *E05C 3/042* (2013.01)

USPC ..... 70/168; 70/169; 404/25; 52/221; 220/325

(58) Field of Classification Search

USPC ..... 70/158, 163, 164, 166–169, DIG. 34; 220/325, 327; 174/48, 50; 404/25; 52/221

See application file for complete search history.

(56) References Cited

U.S. PATENT DOCUMENTS

| | | | | | |
|---|---|---|---|---|---|
| 589,780 | A * | 9/1897 | Howard | 292/202 |
| 1,102,422 | A * | 7/1914 | McKeon | 49/35 |
| 1,170,094 | A * | 2/1916 | Neff | 292/212 |
| 1,342,563 | A * | 6/1920 | More | 292/240 |
| 1,384,712 | A * | 7/1921 | Shanley | 404/25 |
| 1,610,123 | A * | 12/1926 | Fairweather | 49/35 |
| 2,114,499 | A * | 4/1938 | Maclear | 49/465 |
| 2,693,100 | A * | 11/1954 | Wiegel | 70/168 |
| 3,921,494 | A * | 11/1975 | Coe | 411/344 |
| 3,929,360 | A * | 12/1975 | Gulistan | 292/67 |
| 3,973,856 | A * | 8/1976 | Gaglioti | 404/25 |
| 5,697,729 | A * | 12/1997 | Bowman | 404/25 |
| 6,007,270 | A * | 12/1999 | Bowman | 404/25 |
| 6,568,226 | B1 * | 5/2003 | Ramsauer | 70/127 |
| 6,953,209 | B2 * | 10/2005 | Jackson et al. | 292/66 |
| 7,160,048 | B1 | 1/2007 | Fattori et al. | |
| 7,347,070 | B1 * | 3/2008 | Spector | 70/169 |
| 7,455,474 | B2 * | 11/2008 | Tievant et al. | 404/25 |
| 7,547,051 | B2 * | 6/2009 | Burke et al. | 292/206 |
| D597,194 | S | 7/2009 | Fattori et al. | |
| 7,780,372 | B2 | 8/2010 | Fattori et al. | |
| 7,946,143 | B2 * | 5/2011 | Rafferty et al. | 70/164 |
| 8,096,440 | B2 * | 1/2012 | Rhetat et al. | 220/573.1 |
| 8,178,795 | B2 * | 5/2012 | Roy | 174/666 |
| 8,347,670 | B2 * | 1/2013 | Rix | 70/168 |
| 2013/0101347 | A1 * | 4/2013 | Taylor | 404/25 |

* cited by examiner

*Primary Examiner* — Suzanne Barrett

(74) *Attorney, Agent, or Firm* — Stephens & Domnitz, PLLC

(57) ABSTRACT

A storm grate locking device and method of use with a lock body. The lock body has at least one hook arm engaged with a latch assembly, a security flange nut engaged with the latch assembly, and a deep well socket. When the lock body is placed into the recessed area of a storm grate; and the hook arm engaged with the latch assembly may be extended to extend under the storm grate thereby preventing removal of the storm grate by rotating the security flange nut.

10 Claims, 2 Drawing Sheets

STORM GRATE LOCK DEVICE AND METHOD OF USE

CROSS-REFERENCE TO RELATED APPLICATIONS

This application claims priority to U.S. provisional patent application 61/588,259, filed Jan. 19, 2012, which is incorporated by reference herein in its entirety.

STATEMENT REGARDING FEDERALLY SPONSORED RESEARCH

Not applicable

BACKGROUND

The present invention generally relates to a lock down system for loose cast iron grates to prevent accidental or unwanted removal of the grate from its frame without the proper security removal tool. The present invention prevents the previous problems associated with persons removing the grates through use of generic tools.

SUMMARY

In various embodiments, the present invention describes a lock system that is designed to be attached to an existing cast iron loose grate that sits in a cast iron frame allowing the loose grate to be locked into the frame so it cannot be removed from the frame accidently, or on purpose, without the proper tool to unlock the security locking bolt. The inventive lock system consists of a lock body with a latch assembly attached to the bottom with a stainless steel bolt, or other substantially strong bolting material, washer and nut combination tightened down into the locked position with a special security flange nut that cannot be untightened with any standard socket, wrench or pliers. The locking bolt causes the latch to rotate out from the lock system to the locked position as it is tightened with the locking tool and causes the latch to move to the unlocked position as the locking bolt is untightened with the locking tool. There are two hook arms that are attached to the bottom of the grate that extend out to lock under the frame to lock the back side of the grate in position while the present inventive lock system locks down the front of the grate.

In various embodiments, the present invention describes an apparatus for locking a storm grate which has a lock body. The lock body further comprises at least one hook arm engaged with a latch assembly, a security flange nut engaged with the latch assembly, and a deep well socket. In one embodiment of the present invention, the lock body is placed into the recessed area of a storm grate; and the hook arm engaged with the latch assembly may be rotated to extend under the storm grate thereby preventing removal of the storm grate by rotating the security flange nut.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 2:
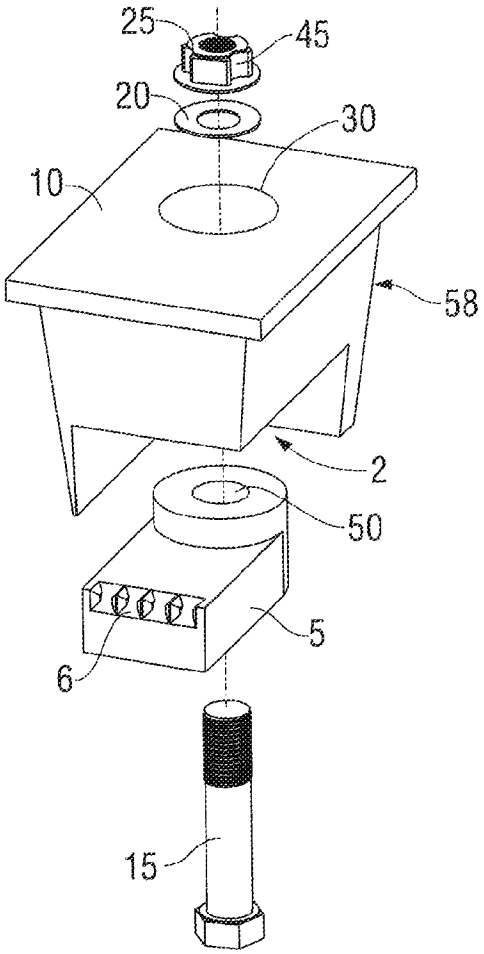
FIG. 2 illustrates an exploded view one embodiment of the present invention.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not, unless specifically stated in this specification or if the incorporation is necessary for maintaining validity.

In general, the apparatus, systems and methods of the present disclosure are distinguished from and advantageous over other storm grate locks that are conventional in the art, because the systems and methods of the present disclosure use a new and novel locking system that cannot be opened through conventional tools.

Figure 1:
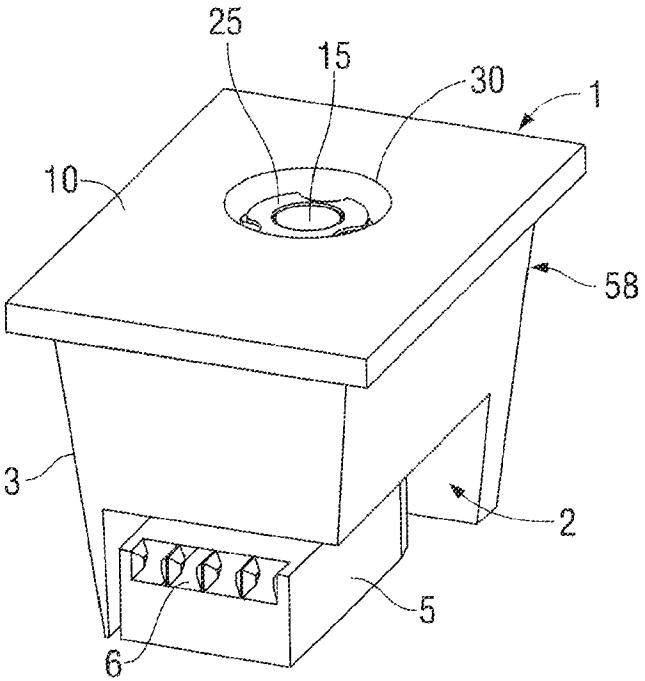
FIG. 1 illustrates one embodiment of the present device engaging a sewer grate in operation.

As shown in FIG. 1, in various embodiments, the present disclosure describes a lock body 1 (which may be made out of cast iron, or other suitable materials), at least one iron hook arms 5 (which may be made out of cast iron, or other suitable materials), a latch assembly 10 (which may be made out of cast iron, bronze, or other suitable materials), metal bolts 15 (which may be made out of cast iron, bronze, or other suitable materials), washer 20 (which may be made out or cast iron, bronze, or other suitable materials), a security flange nut 25 (which may be made out of cast iron, bronze, or other suitable materials), and a deep well socket 30 used in various combinations as disclosed to create a new and novel storm lock system.

Figure 3:
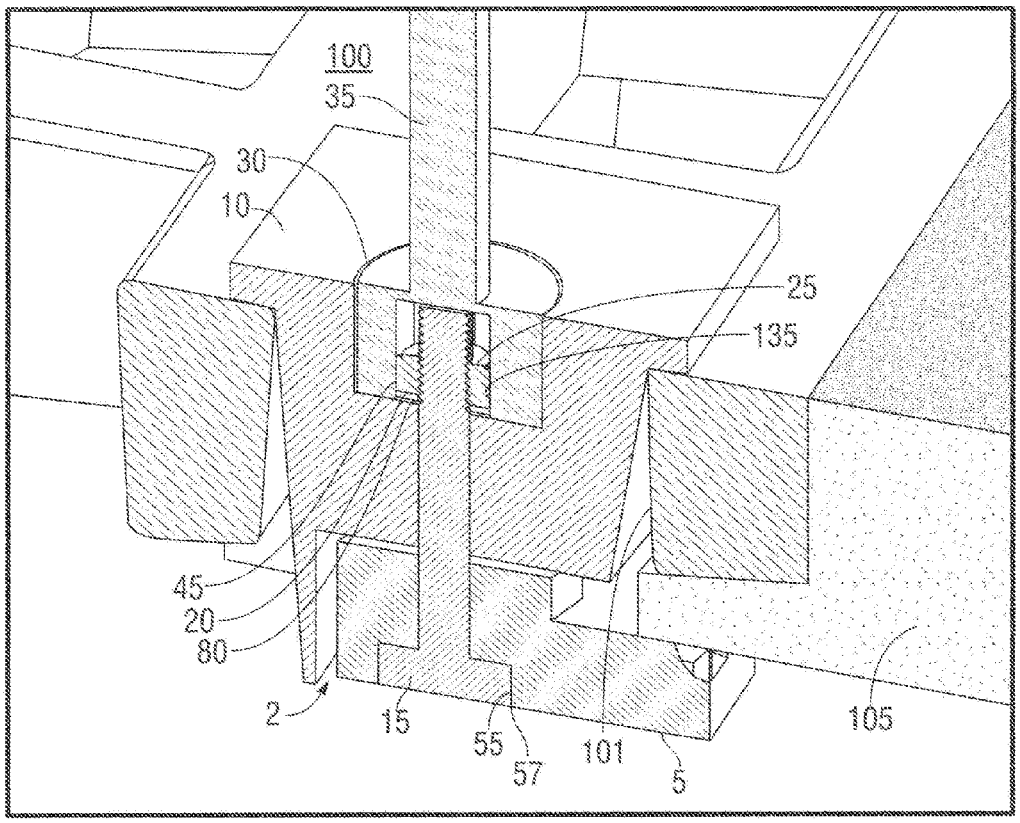
FIG. 3 illustrates a cross sectional drawing of a complete system of one embodiment of the present invention.
Figure 4:
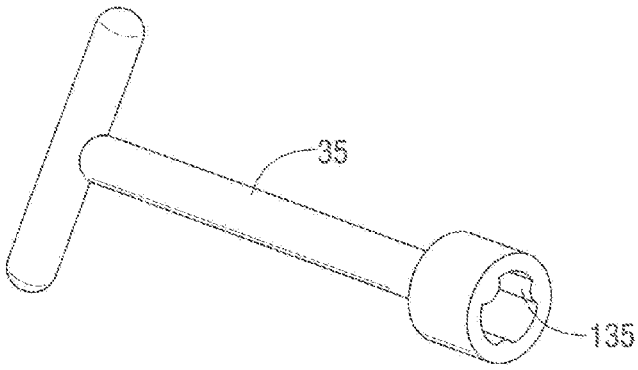
FIG. 4 illustrates a side view of the turning key of one embodiment of the present invention.

As shown in FIG. 3, the lock body 1 fits into the receiving hole 101 in the storm grate 100. Located below the lock body 1 and under the storm grate 100, is the latch assembly 10. On the top portion of the lock body 1, is the security flange nut 25 and releasably engaging the security flange nut 25 is the turning key 35. Both the turning key 35 and the security flange nut 25 have matching female 135 and male 45, respectively, engagement faces to allow the turning key 35 and security flange nut 25 to interact, FIGS. 1 and 4. It is envisioned that the engagement faces of the turning key 35 and the security flange nut 25 will be of unique geometric patterns so that the turning key 35 and security flange nut 25 could not be engaged by commercially available tools such as, but not limited to, screwdrivers, sockets, Allen wrenches, nut drivers, and the like.

As shown in FIG. 3, the latch assembly 10 is engaged and the hook arm 5 is rotated to a distance under the storm grate mounting frame 105. When engaged, the storm grate 100 cannot be lifted off the mounting frame 105 due to the presence of the hook arm 5.

FIG. 2 illustrates an exploded version of one embodiment of the lock body of the present inventive system. As shown in FIG. 2, the lock body 1 part is smaller on four sides than the receiving hole 101 in the storm grate 100 to be refurbished. This allows the lock body 1 to be placed into the receiving hole 101 when in use. In one embodiment of the invention there could be a two to three degree taper 3 from top to bottom of the lock body 1 with the top being smaller than the bottom. One of ordinary skill in the art could envision varying sizes and degree of taper in the lock body 1.

In one embodiment of the present invention, the taper 3 serves two functions. It is envisioned that one function of the taper 3 can be to allow the lock body 1 to fit in the receiving hole 101 in the storm grate 100 (which may be cast iron) in which the receiving hole 101 has a built in taper as well. It is envisioned that the second function of the taper 3 may be to allow the lock body 1 to be wedged into the receiving hole 101 by force using a small hammer, or other suitable tool.

In one embodiment of the present invention, the lock body 1 has a preferably one cut out 2 on the front right hand corner for the latch assembly 10 to be mounted in with a bolt 15. It is envisioned that one of ordinary skill in the art could fashion the cut out 2 in a variety of differing dimensions, and in varying locations on the lock body 1. In one embodiment of the present invention, two sides of the cut out 2 on the bottom are open to allow the hook arm 5 to turn from the locked position to the open position and the third side will be solid in order to stop the hook arm 5 in the locked position.

In one embodiment of the present invention, the lock body 1 has a bolt hole 50 located in the interior through which to attach the latch assembly 10 on the bottom of the lock body 1. In one embodiment of the invention, the bolt hole 50 may be beveled to allow the security flange nut 25 to be recessed where it cannot be accessed by hand or with various commercial tools, but not limited to, screwdrivers, sockets, Allen wrenches, nut drivers, and the like. In one embodiment of the invention is it envisioned that the security flange nut 25 will have five sides. In one embodiment of the invention it is envisioned that the security flange nut 25 will be approximately one inch in diameter.

FIG. 3 illustrates a cut away view of one embodiment of the latch assembly 10, of the present invention. In one embodiment of the invention, the latch assembly 10 has a hex recess in the bottom 55 to hold the head of the bolt 15 that is inserted through a bolt hole 50 drilled through the latch assembly 10 in the center of the hex hole so the latch arm 5 can be extended when the security flange nut 25 is turned from the top of the cast iron lock body 1. The latch assembly 10 is attached to the cast iron lock body 1 by a stainless steel bolt 15. The bolt 15 is inserted into the hex receiver 57 in the bottom of the latch assembly 10.

In one embodiment of the present invention, a washer 20 goes between the latch assembly 10 and the upper lock 58. In one embodiment of the present invention, there can be multiple washers 20 that go in the recess in the top of the lock body 1 between the lock body 1 and the security flange nut 25. In one embodiment of the present invention, in order to keep the flange nut 25 from coming off the end of the bolt 15 a super adhesive material 80, as is known in the art is used to adhere the bolt 15 to the security flange nut 25. In another embodiment of the present invention, the security flange nut 25 can be adhered to the bolt 15 by pinning, or securing through the use of a pin, thereby preventing the bolt from falling out through the bolt hole 50.

In one embodiment of the invention, the hook arms 5 have ridged areas at the end which are stacking fins 6. The stacking fins 6 maybe prefabricated in a mold or adhered using materials known in the art to the hook arms 5. These hooks arms 5 will fit under the frame to create an additional physical lock for the back of the grate.

As shown in FIG. 3, one embodiment of the present invention operates in the following manner. The lock body 1 is placed into the receiving hole 101 in the storm grate 100. The turning key 35, is releasably engaged with the security flange nut 25. When the turning key 35 is rotated, the security flange nut 25, attached to the bolt 15 is rotated in the same direction. The bolt 15 is engaged with the hook arm 5 of the latch assembly 10 and the hook arm 5 is forced through the rotation of the bolt 15 to extend outward into the locking position under the storm grate 100 and mounting frame 105 thereby locking the storm grate 400 down and preventing removal without the specific turning key 35. In order to unlock the storm grate 100, the turning key 35 is releasably engaged with the security flange nut 25 and the security flange nut 25 is rotated in the opposite direction. When the security flange 25 is rotated in the opposite direction then the hook arm 5 will move into the latch assembly 10 and out from under the mounting frame 105.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

What is claimed is the following:

1. A system for locking a storm grate comprising:
a storm grate;
a storm grate mounting frame;
a lock body;
said lock body further comprising;
an upper lock;
a bolt hole running through the lock body;
said bolt hole further comprising a bolt hole upper lock portion and a bolt hole lower portion; and
a bolt located interior to the bolt hole;
said bolt further comprising a bolt upper lock portion and a bolt lower portion;
at least one hook arm engaged with said bolt lower portion, wherein said at least one hook arm is located below the upper lock; and
a security flange nut attached to the bolt with joined rotation capacity;
wherein said security flange nut is accessible only through said bolt hole upper lock portion;
wherein said lock body is in mechanical communication with said storm grate mounting frame; and
wherein said lock body further comprises as part of the lock body, a cut out portion of the lock body and a wall opposite an opening to the cut out portion, wherein the wall is sufficiently solid to serve as a stop to the at least one hook arm in a locked position.

2. The system for locking a storm grate of claim 1, wherein said cut out portion is part of the upper lock, and such cut out portion acts as a receptacle for receiving said at least one hook arm.

3. The system for locking a storm grate of claim 1 wherein the security flange nut further comprises multiple sides and an engagement face for engaging a turning key with corresponding solid geometric engagement face shape, wherein said engagement face is a geometrically-shaped hole located on at least a portion of said face of said security flange nut and wherein said engagement face and turning key engagement face are proprietary, thereby enhancing the security of the system for locking the storm gate.

4. An apparatus for locking a storm grate comprising:
a lock body;
said lock body further comprising;
an upper lock;
said upper lock further comprising a cut out for receiving at least one hook arm;
a bolt hole running through the lock body;
said bolt hole further comprising a bolt hole upper lock portion and a bolt hole lower portion;
a bolt located interior to the bolt hole:
said bolt further comprising a bolt upper lock portion and a bolt lower portion;
said at least one book arm engaged with said holt lower portion, wherein said at least one hook arm is located below the upper lock;
wherein said lock body is in mechanical communication with said storm grate, through mechanical communication with a frame surrounding said storm grate;
wherein said lock body comprises as part of the lock body, the cut out portion of the lock body and a wall opposite an opening to the cut out portion, wherein the wall is sufficiently solid to serve as a stop to the at least one hook arm in a locked position;
a security flange nut attached to the bolt with joined rotation capacity; and
wherein said security flange nut is accessible only through said bolt hole upper lock portion.

5. The apparatus for locking a storm grate of claim 4 wherein
said security flange nut further comprises multiple sides and a face.

6. The apparatus for locking a storm grate of claim 4 further comprising:
an engagement face for engaging a turning key with corresponding solid geometric engagement face shape, wherein said engagement lace is a geometrically-shaped hole located on at least a portion of said face of said security flange nut.

7. A method for utilizing an apparatus for locking a storm grate comprising the steps of:
obtaining an apparatus for locking said storm grate, wherein said apparatus comprises:
a lock body;
said lock body further comprising;
an upper lock;
said upper lock further comprising a cut out for receiving at least one hook arm;
wherein said cut out comprises a portion of the lock body and a wall opposite an opening to the cut out portion, wherein the wall is sufficiently solid to serve as a stop to the at least one hook arm in a locked position;
a bolt hole running through the lock body;
said bolt hole further comprising an upper lock portion and lower portion;
a bolt located interior to the bolt hole;
said bolt further comprising an upper portion and a lower portion;
and said apparatus further comprising a security flange nut attached to the bolt, wherein said security flange nut is accessible only through said upper lock portion of said bolt hole;
engaging said at least one hook arm with the lower portion of said bolt located below the upper lock;
establishing mechanical communication between the lock body and a mounting frame, wherein said mounting frame is in mechanical communication with said storm grate;
placing said lock body into the recessed area of said storm grate; and
rotating the security flange nut causing the bolt to rotate causing the hook arm be rotated to extend under said storm grate thereby preventing removal of said storm grate.

8. The method for locking a storm grate of claim 7;
wherein said security flange nut has multiple sides.

9. The method for locking a storm grate of claim 7 wherein;
said security flange nut has a geometric shaped hole engagement face for engaging a turning key with corresponding solid geometric engagement face shape.

10. The method for locking a storm grate of claim 7 further comprising further the steps of:
reversing rotation of the bolt causing the hook arm to be rotated and to be retracted from the storm grate thereby unlocking the storm grate; and
placing said at least one hook arm into mechanical communication with said upper lock body further through said cut out.

* * * * *